US007025049B2

(12) United States Patent
Pietschner

(10) Patent No.: US 7,025,049 B2
(45) Date of Patent: Apr. 11, 2006

(54) APPARATUS FOR VENTILATING THE CRANKCASE OF A COMBUSTION ENGINE

(75) Inventor: Sieghard Pietschner, Greven (DE)

(73) Assignee: Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 10/494,641

(22) PCT Filed: Nov. 7, 2002

(86) PCT No.: PCT/EP02/12417

§ 371 (c)(1),
(2), (4) Date: Nov. 15, 2004

(87) PCT Pub. No.: WO03/042513

PCT Pub. Date: May 22, 2003

(65) Prior Publication Data

US 2005/0061305 A1 Mar. 24, 2005

(30) Foreign Application Priority Data

Nov. 13, 2001 (DE) ..... 201 18 388 U

(51) Int. Cl.
*F01M 13/02* (2006.01)

(52) U.S. Cl. ..... 123/572

(58) Field of Classification Search ..... 123/572–574, 123/41.86
See application file for complete search history.

(56) References Cited

U.S. PATENT DOCUMENTS

| | | | | |
|---|---|---|---|---|
| 4,901,703 | A * | 2/1990 | Humphries | 123/572 |
| 5,335,641 | A | 8/1994 | Schnabel | |
| 5,669,366 | A | 9/1997 | Beach et al. | |
| 6,505,615 | B1 * | 1/2003 | Pietschner | 123/572 |
| 6,892,715 | B1 * | 5/2005 | Norrick | 123/572 |
| 2002/0088445 | A1 * | 7/2002 | Weindorf et al. | 123/572 |
| 2004/0112346 | A1 * | 6/2004 | Ahlborn et al. | 123/572 |

FOREIGN PATENT DOCUMENTS

| | | |
|---|---|---|
| DE | 200 09 605 | 10/2001 |
| FR | 2 815 084 | 4/2002 |
| WO | WO 03/042513 | * 5/2002 |

* cited by examiner

*Primary Examiner*—Marguerite McMahon
(74) *Attorney, Agent, or Firm*—Sonnenschein Nath & Rosenthal LLP

(57) ABSTRACT

The invention relates to a device for crankcase ventilation of an internal combustion engine, comprising a ventilation duct extending from the crankcase to an induction tract of the internal combustion engine, whereby at least one oil vapor separator causing a drop in pressure is arranged in said duct and a crankcase vacuum control valve is arranged upstream or downstream therefrom and can be adjusted according to the pressure in the crankcase such that a lower pressure threshold valve in the crankcase is respected. The novel device is characterized in that a discharge duct extending from the crankcase to the induction tract of the internal combustion engine is also provided, whereby a crankcase overpressure limiting valve is disposed inside said duct and can be adjusted in a pressure-dependent manner to ensure that an upper pressure threshold in the crankcase is not exceeded.

18 Claims, 2 Drawing Sheets

APPARATUS FOR VENTILATING THE CRANKCASE OF A COMBUSTION ENGINE

BACKGROUND OF THE INVENTION

The present invention relates to an apparatus for ventilating the crankcase of a combustion engine, comprising a ventilation duct running from the crankcase to an intake section of the combustion engine and at least one oil-mist separator that causes a pressure drop and is arranged in the course of the ventilation duct, with a crankcase vacuum pressure regulating valve that is installed upstream or downstream of the oil-mist separator and is adjustable dependent on the crankcase pressure such that the pressure in the crankcase is prevented from falling below a lower pressure limit value.

During operation of a combustion engine, gas is pressed out of the combustion chamber and into the crankcase through the gap between the piston rings and the cylinder walls, this gas being called blow-by gas. This gas increases the pressure in the crankcase and must, therefore, be removed. Usually, the blow-by gas is supplied into the intake section of the combustion engine via a crankcase vacuum pressure regulating valve. Emission of noxious substances out of the crankcase is, thus, avoided. The regulating valve is provided to maintain a range of pressure in the crankcase that is optimal from a technical point of view. Too low a crankcase pressure must be avoided in order to prevent foreign substances from entering into the crankcase from outside through leaks. Too high a crankcase pressure must, vice versa, also be avoided in order to prevent oil or gas from exiting through leaks in an uncontrolled manner.

The blow-by gas contains fine oil particles in the form of oil mist which might cause malfunctions of the combustion engine when the gas is being returned into the intake section of the combustion engine. For that reason, the oil mist must be separated from the gas. To achieve this, at least one separator is arranged in the course of the ventilation duct carrying the blow-by gases, usually either as a coalescer made of textile fiber materials or as a cyclone. An apparatus for ventilating the crankcase of a combustion engine comprising the features and functions illustrated above is described in the applicant's non-prepublished German utility model registration application 200 09 605.2.

The performance of the separator in such an apparatus is, in particular, determined by the flow resistance that is generated by the respective blow-by gas volume flow. In this context, it can generally be observed that a high separation rate is associated with a high flow resistance and vice versa. The flow resistance in the separator is a disadvantage in that it also increases the pressure in the crankcase accordingly. If the combustion engine is, for example, in operating states where it is subject to high speeds and high load, this increase in pressure in the crankcase is compensated by the high vacuum pressure that is then present in the intake section. In this manner, the pressure in the crankcase is prevented from assuming too high values. If, however, the vacuum pressure in the intake section of the combustion engine is only low, as is the case at low speeds or in the deceleration mode of the combustion engine, then there is the risk of the pressure in the crankcase rising to an impermissibly high value.

SUMMARY OF THE INVENTION

For that reason, the present invention aims at creating an apparatus of the aforementioned type, which obviates the drawback disclosed and which, in particular, ensures that the pressure in the crankcase is reliably prevented from assuming values that are too low or too high and which, at the same time, ensures that the oil mist is, all in all, separated from the blow-by gas in a satisfactory manner.

This problem is solved by the invention by an apparatus of the aforementioned type, characterized in that a relief duct is, in addition, provided, said relief duct running from the crankcase to the intake section of the combustion engine, wherein a crankcase excess pressure limiting valve is arranged in the course of said relief duct, which valve can be adjusted dependent on the pressure such that an upper pressure limit value is prevented from being exceeded in the crankcase.

The additional relief duct and the crankcase excess pressure limiting valve provided therein are advantageous in that too high a pressure is prevented from developing in the crankcase in any operating state of the combustion engine. Once the pressure in the crankcase reaches a maximum limit value, the limiting valve and, thus, the relief duct is opened, limiting the pressure in the crankcase to this specifiable maximum pressure limit value. During operation of the combustion engine, the blow-by gas does not only flow through the relief duct, even if the limiting valve is open; a part of the blow-by gas also flows through the ventilation duct and the oil-mist separator provided therein. If the pressure in the crankcase is below the upper pressure limit value, the limiting valve is closed and blow-by gas does not flow through the relief duct. In this case, the total amount of blow-by gas flows through the ventilation duct and the oil-mist separator provided therein. Hence, the relief duct is opened only in operating states of the combustion engine that occur relatively rarely. The relief duct is closed by the excess pressure limiting valve for most of the operating time. In order to achieve quick and efficient relief from pressure in the crankcase if need be, components with an excessively high flow resistance which might cause development of a differential pressure are not provided in the relief duct. If necessary, it may be appropriate to incorporate an additional coarse-particle separator with low resistance in the relief duct, in order to also avoid oil from being entrained over to the pure or oil free side when the relief duct is open. Hence, it must also be assumed that the oil mist contained in the blow-by gas flowing through the relief duct is not completely separated therefrom. This appears to be to disadvantage at first sight, but does, in practice, not deteriorate the effect of the apparatus as such.

Totaled over all operating ranges during normal operation of the combustion engine, the apparatus according to the invention, as such, results in a better oil-mist separation than the apparatuses used so far, because the number of operating points where the relief duct is open is relatively low as compared with the number of operating states where the relief duct is closed.

Alternatively, the relief duct provided according to the invention provides the advantageous possibility of designing the oil-mist separator arranged in the ventilation duct with a higher efficiency since a higher pressure drop over the oil-mist separator no longer results in problems to the combustion engine, caused by too high a pressure in the crankcase.

It is, furthermore, possible to design the geometry of the relief duct and the crankcase excess pressure limiting valve arranged therein such that, by appropriately routing and diverting the flow, there will be an impingement separation of oil droplets without there being a pressure drop, so that the oil mist and, in particular, any coarse-particle oil is, at least in part, also separated from the blow-by gas in the relief duct. This also prevents coarse-particle oil from being entrained through the relief duct.

It is, furthermore, preferably provided that the crankcase excess pressure limiting valve can be adjusted dependent on the difference between the crankcase pressure and a reference pressure. In this manner, a particularly exact pressure limit value can be specified for the pressure in the crankcase.

It is appropriate to use the atmospheric pressure directly as the reference pressure for the crankcase excess pressure limiting valve because this pressure can be considered to be the upper pressure limit value for the crankcase pressure. Thus, a technically simple solution is to allow a pressure in the crankcase that is negative as compared with the atmosphere. The fact that the atmospheric pressure is available at all times and in all places is to further advantage. It is, however, also possible to select any vacuum source desired as reference pressure.

Furthermore, the crankcase excess pressure limiting valve is preferably a diaphragm valve with a diaphragm. On the one hand, this reliably ensures proper functioning and, on the other hand, precise responding of the valve, because the differences in pressure that occur are only relatively small.

In a preferred embodiment of the diaphragm valve, the diaphragm is fixed in a diaphragm chamber inside the crankcase excess pressure limiting valve and subdivides said diaphragm chamber into a first chamber section that is connected to the atmosphere and a second chamber section that is connected to the crankcase. Pressures which are governing the valve position are, thus, applied to the diaphragm directly and without any mechanical intermediate elements.

Furthermore, it is preferably provided that a beginning of that part of the relief duct that is running to the intake section is positioned in the crankcase excess pressure limiting valve, wherein said beginning is formed as a valve seat that is directly cooperating with the diaphragm serving as a part of the valve body and is arranged in the second chamber section. This permits, advantageously, to achieve a limiting valve, the only moving part of which is the diaphragm, thus providing a structure that is as simple as possible from a mechanical point of view. A valve spring can be provided as an option. A separate valve body is not required either since the diaphragm itself acts as a valve body directly cooperating with the valve seat. As long as the pressure in the crankcase is below the atmospheric pressure, the atmospheric pressure ensures that the diaphragm is supported by the valve seat so that the valve then assumes its closing position and shuts off the relief duct. The vacuum pressure present in the intake section additionally ensures that the diaphragm is tightly resting on the valve seat, since the vacuum pressure in the intake section propagates without any pressure loss through the part of the relief duct the beginning of which represents the valve seat. Only if the pressure in the crankcase rises to a value above the atmospheric pressure will the diaphragm be lifted off the valve seat and the relief duct be opened.

To ensure that the diaphragm is reliably lifted off its valve seat as described above, it is appropriately provided that the effective area of the diaphragm is a multiple of the cross-sectional area of the valve seat. In this manner, the effect of the vacuum pressure in the intake section on the adjustment of the diaphragm is minimized so that adjustment of the diaphragm is, in essence, determined only by the pressure ratio between the crankcase and the atmosphere.

A further embodiment of the apparatus provides that an additional duct bypassing the oil-mist separator is provided, said bypass duct running from the inflow side to the outflow side of the oil-mist separator, with a bypass valve, a so-called separator differential pressure limiting valve, being arranged in the course of said bypass duct. Said separator differential pressure limiting valve can be manufactured such that, depending on the difference between the inflow-side pressure on the dirty side of the separator and the outflow-side pressure on the clean side of the separator, it is adjustable such that it opens if a specifiable maximum pressure difference over the oil-mist separator is exceeded. This bypass duct, including its separator differential pressure limiting valve, ensures that blow-by gas flows around the oil-mist separator if there is an excessive pressure drop over the oil-mist separator, for example because the latter is clogged by oil, so that, in this case, additionally positive crankcase pressures are avoided which might, otherwise, develop as a result of an overload of the relief duct. Moreover, it is, hence, possible to design the relief duct with a relatively small cross-section, thus saving free space. The bypass valve can also be used to provide the operating personnel of the combustion engine with a device indicating that the oil-mist separator requires maintenance, for example replacement of a separator insert.

To minimize the number of line connections and other connections during assembly of the apparatus and its attachment to a combustion engine, it is, advantageously, provided that the ventilation duct and the relief duct are designed as a common duct section over a part of their length upstream and/or downstream of the oil-mist separator and of the associated crankcase vacuum pressure regulating valve.

Over and above this, it is furthermore provided that, in order to achieve a compact construction and an easy connectability of the apparatus to an associated combustion engine, the oil-mist separator, the crankcase vacuum pressure regulating valve, the separator differential pressure limiting valve and, if provided, the crankcase excess pressure limiting valve as well as at least partial sections of the ducts are comprised to form one assembly-forming module that can be connected to the associated combustion engine either directly or via tubings or pipelines.

BRIEF DESCRIPTION OF THE DRAWING

An exclusive example of the invention will be illustrated below by means of a drawing, in which.

DETAILED DESCRIPTION OF THE PREFERRED EMBODIMENT

Figure 1:
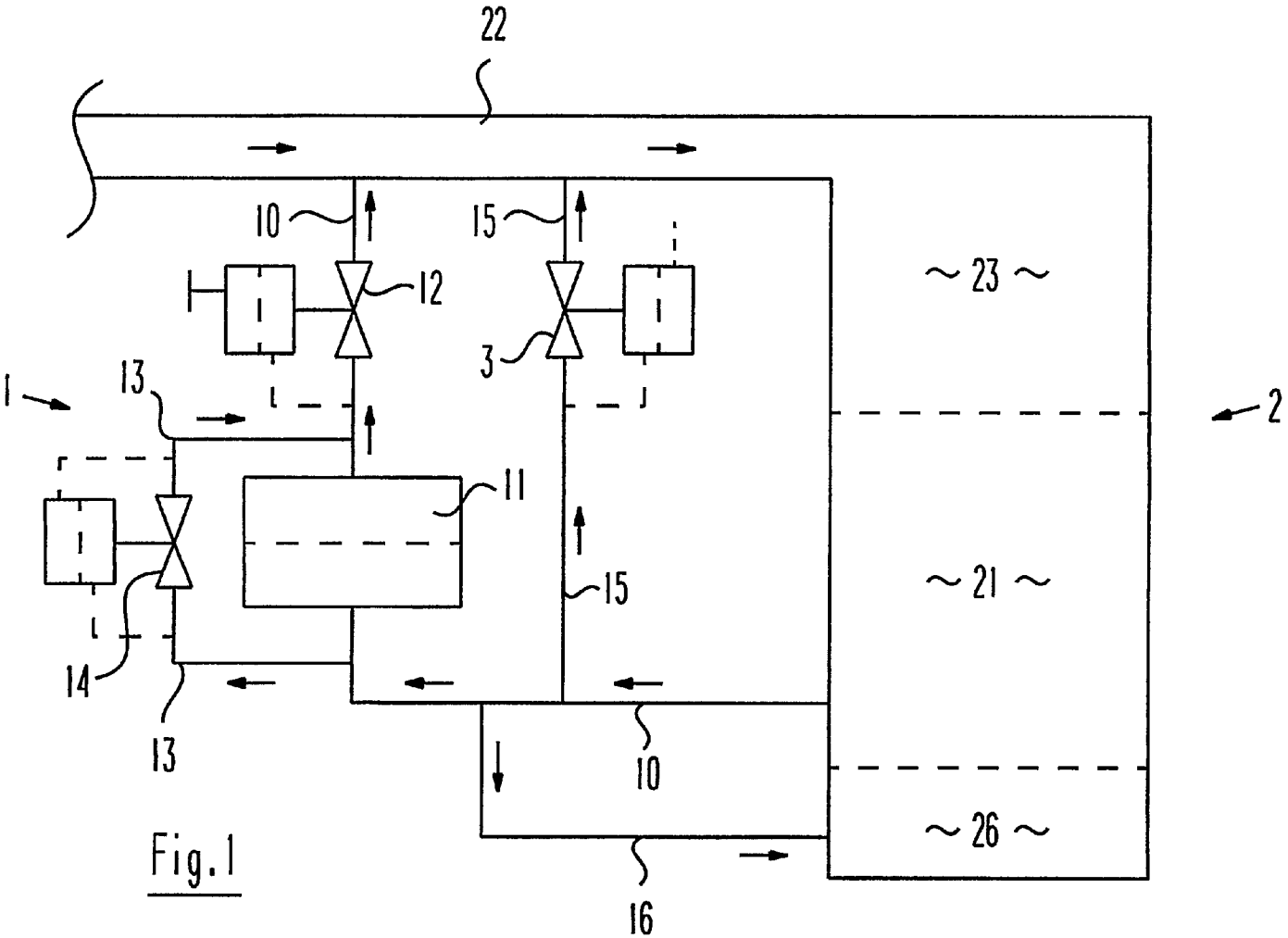
FIG. 1 is a schematic functional representation of an apparatus for ventilating the crankcase of a combustion engine.

To its extreme right, FIG. 1 of the drawing shows a combustion engine 2 that comprises a crankcase 21 in its lower part and one or more combustion chambers 23 in its upper part. An intake section 22 through which combustion air is supplied to the combustion chambers 23 of the combustion engine 2 ends in the combustion chambers 23.

An apparatus 1 for ventilating the crankcase 21 is allocated to the combustion engine 2. This apparatus 1 first comprises a ventilation duct 10 that starts in the crankcase 21 and extends to the intake section 22. An oil-mist separator 11 used to separate oil mist consisting of fine oil droplets from blow-by gas that is supplied from the crankcase 21 into the intake section 22 is arranged in the course of this ventilation duct 10. Furthermore, a crankcase vacuum pressure regulating valve 12 is provided in the ventilation duct 10, downstream of the oil-mist separator 11 as seen in flow direction. This regulating valve 12 serves to limit the vacuum pressure in the crankcase 21 that is caused by the vacuum pressure present in the intake section 22 to a specifiable vacuum pressure value; for technical reasons, the pressure in the crankcase 21 must not fall below this specifiable vacuum pressure value.

Furthermore, the apparatus 1 comprises an oil-separator bypass duct 13 that branches off the ventilation duct 10 upstream of the oil-mist separator 11 and that ends in the ventilation duct 10 downstream of the oil-mist separator 11. A separator differential pressure limiting valve 14 that is adjustable subject to the pressure drop over the oil-mist separator 11 is arranged in the course of this bypass duct 13. Once the pressure drop over the oil-mist separator 11 exceeds a specifiable upper limit value, the bypass valve 14 opens so that at least a part of the blow-by gas bypasses the oil-mist separator 11 and flows through the bypass duct 13. A line/return 16 of separated oil from all regions of the separator system back into the oil pan 26 of the motor 2 is provided at the bottommost point of the system. In order to avoid any undesired gas flow extending from bottom to top through the oil return duct 16, it is provided to design the lower end of the duct 16 such that it comprises a siphon or a check valve.

Up to this point in the description, the apparatus 1 corresponds to current apparatuses for the ventilation of crankcases.

The essential innovation of the apparatus 1 illustrated in FIG. 1 comprises provision of an additional relief duct 15 that connects the crankcase 21 to the intake section 22. The only component incorporated in this relief duct 15 is a crankcase excess pressure limiting valve 3 that ensures that any harmful excess pressure in the crankcase 21 is avoided. The limiting valve 3 is designed such that it opens the relief duct 15 as soon as the pressure in the crankcase 21 exceeds the atmospheric pressure. Any excess pressure in the crankcase 21 is, thus, relieved quickly and efficiently or is avoided from the start. A fine-particle oil-mist separator or any other component causing an excessive and, thus, disturbing pressure drop is not provided in the course of the relief duct 15, so that, when the limiting valve 3 is open, the pressure in the crankcase 21 immediately drops to the pressure present in the intake section 22. Since, compared with the atmospheric pressure, a certain, though low vacuum pressure is still present in the intake section 22 even in case of the most unfavorable operating states of the combustion engine, a pressure in excess of the atmospheric pressure is, at any rate, avoided in the crankcase 21.

Since an oil-mist separator is not arranged in the relief duct 15, there is no selective and complete fine-particle oil-mist separation; by appropriately routing and forming the relief duct 15, however, it is possible to achieve partial separation of coarse-particle oil/oil splashes by a part of the oil droplets being separated by means of impingement separation and being collected on the walls of the relief duct 15. From there, selective drainage, for example into a collection tank or into the crankcase 21 of the combustion engine 2, can be achieved in the same manner as is known from the usual oil-mist separators.

In the apparatus according to FIG. 1, the oil-mist separator 11 can be designed with a high degree of separation, resulting in a high differential pressure. Here, however, this high differential pressure is not harmful to the pressure in the crankcase 21, since the crankcase pressure is, with priority, limited upwards by the crankcase pressure limiting valve 3 that is separately provided in the relief duct 15. All in all and over the various operating states and the life of the combustion engine 2, the apparatus 1, thus, provides a degree of separation of oil droplets from the oil mist that is, altogether, higher than that of usual apparatuses which are not provided with a relief duct 15 comprising a crankcase excess pressure limiting valve 3.

Figure 2:
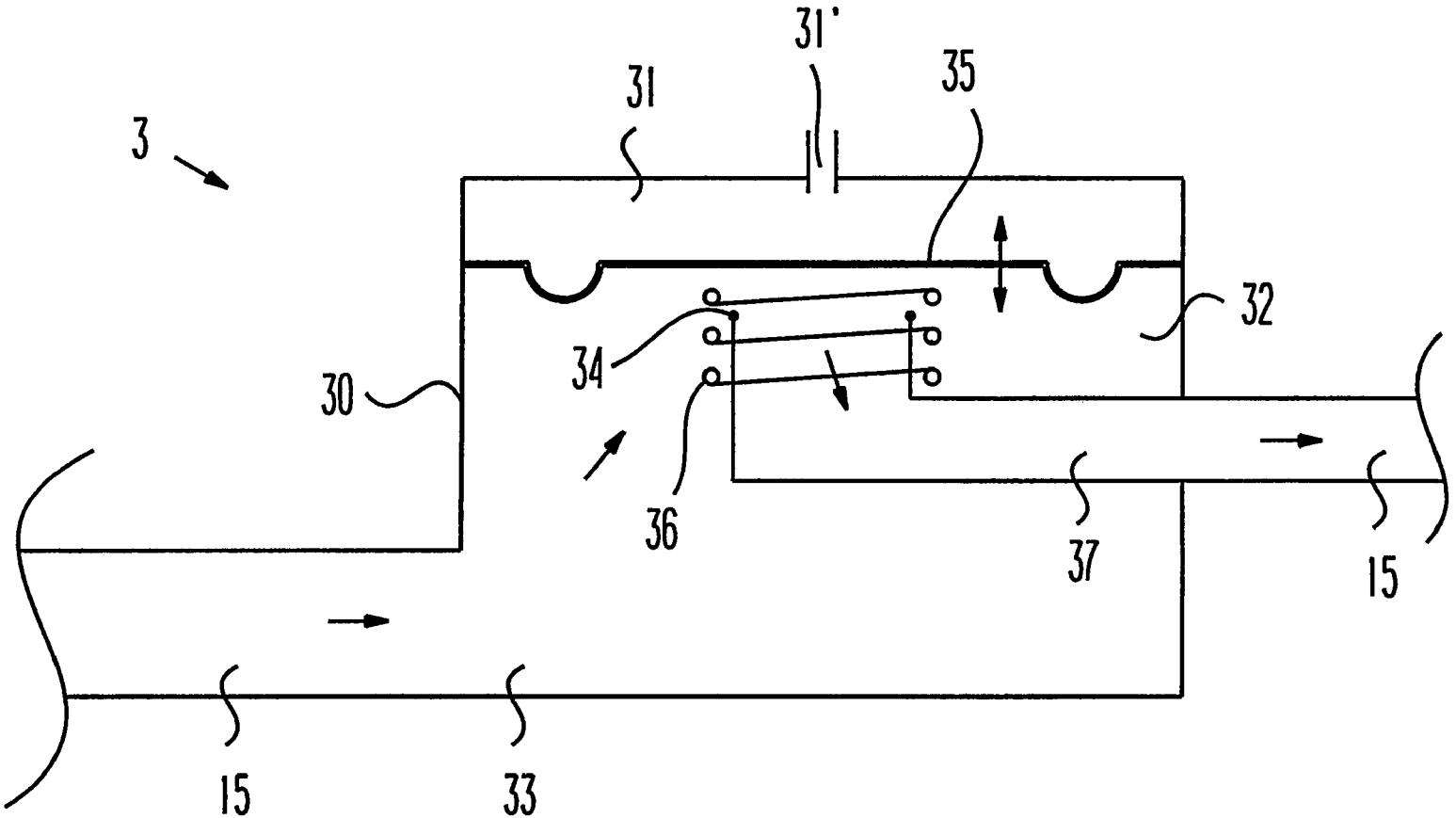
FIG. 2 is also a schematic representation of a crankcase pressure limiting valve as a part of the apparatus according to FIG. 1.

FIG. 2 of the drawing shows a possible embodiment of the crankcase excess pressure limiting valve 3 as part of the apparatus 1 from FIG. 1. A section of the part of the relief duct 15 coming from the crankcase 21, which ends in a diaphragm chamber 30 of the limiting valve 3 through an inlet 33, can be seen to the lower left of FIG. 2. A diaphragm 35 that is movable in perpendicular direction to its area plane and subdivides the diaphragm chamber 30 into an upper chamber section 31 and a lower chamber section 32 is fixed in the diaphragm chamber 30. The upper chamber section 31 is connected to the open atmosphere via a hole 31' so that the pressure present in the upper chamber section 31 always corresponds to the atmospheric pressure.

The inlet 33 ends in the lower chamber section 32. Furthermore, the beginning of the second part of the relief duct 15 running from the limiting valve 3 to the intake section 22, which forms an outlet 37 of the limiting valve 3, is arranged in the lower chamber section 32 of the diaphragm chamber 30. The beginning of this section of the relief duct 15 is arranged concentrically to and underneath the diaphragm 35 and forms a valve seat 34. The diaphragm 35 which here, at the same time, acts as valve body cooperates with this valve seat 34.

As long as the pressure in the crankcase 21 to which the relief duct 15 is connected on the side of the inlet 33 of the limiting valve 3 is below the atmospheric pressure, the atmospheric pressure presses the diaphragm 35 onto the valve seat 34, so that the limiting valve 3 and, thus, the relief duct 15 is then closed. Once a pressure that exceeds the atmospheric pressure develops in the crankcase 21, the difference in pressure on the two sides of the diaphragm 35 causes said diaphragm to be lifted off the valve seat 34, so that the limiting valve 3 and the relief duct 15 are now open. In this condition, blow-by gas starts to flow through the relief duct 15 from the crankcase 21 and directly into the intake section 22, as represented by the arrows in FIG. 2. Once the pressure in the crankcase 21 has again dropped to a value below the atmospheric pressure, the diaphragm 35 returns to its closed position, thus closing the relief duct 15.

If the valve 3 is to open and close at other pressure values, an additional compression spring 36 exerting on the diaphragm 35 a preloading force that acts in opening direction can be arranged underneath the diaphragm 35, as indicated in FIG. 2.

As is illustrated by FIG. 2, the blow-by gas is subjected to a sharp redirection within the range of the valve seat 34, when the crankcase excess pressure limiting valve 3 is open. This redirection causes at least a part of the oil droplets that are carried along in the blow-by gas to deposit on the underside of the diaphragm 35 as a result of impingement separation and to drip from there into the lower section of the diaphragm chamber 30. From there, the oil can be drained selectively, this process not being shown here. In this manner, at least a part of the oil mist is separated from the blow-by gas flowing through the relief duct 15, even if a special oil-mist separator is not arranged in the course of the relief duct 15.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. An apparatus for ventilating a crankcase of a combustion engine, comprising:

a ventilation duct extending from the crankcase to an intake section of the combustion engine, at least one pressure drop causing oil-mist separator arranged along a length of said ventilation duct, a crankcase vacuum pressure regulating valve installed upstream or downstream of said oil-mist separator which is adjustable dependent on a pressure in the crankcase such that the pressure in the crankcase is prevented from falling below a lower pressure limit value, a relief duct extending from the crankcase to the intake section of the combustion engine, a crankcase excess pressure limiting valve arranged along a length of said relief duct, which excess pressure limiting valve can be adjusted to open upon detection of a predetermined pressure such that an upper pressure limit value is prevented from being exceeded in the crankcase.

2. An apparatus according to claim 1, wherein the crankcase excess pressure limiting valve is adjustable dependent on a difference between the crankcase pressure and a reference pressure.

3. An apparatus according to claim 2, wherein atmospheric pressure is used as the reference pressure.

4. An apparatus according to claim 1, wherein the crankcase excess pressure limiting valve is a diaphragm valve with a diaphragm.

5. An apparatus according to claim 4, wherein the diaphragm inside the crankcase excess pressure limiting valve is fixed in a diaphragm chamber and subdivides said diaphragm chamber into a first chamber section that communicates with atmospheric pressure and a second chamber section that communicates with pressure in the crankcase.

6. An apparatus according to claim 5, wherein a beginning of that part of the relief duct that extends to the intake section is positioned in the crankcase excess pressure limiting valve, wherein said beginning is formed as a valve seat that is directly cooperating with the diaphragm which serves as a portion of a valve body, the valve seat being arranged in the second chamber section.

7. An apparatus according to claim 6, wherein an effective area of the diaphragm is a multiple of a cross-sectional area of the valve seat.

8. An apparatus according to claim 1, wherein an additional duct bypassing the oil-mist separator is provided, said bypass duct running from an inflow side to an outflow side of the oil-mist separator, with a separator differential pressure limiting valve being arranged along a length of said bypass duct and, depending on a difference between an inflow side pressure and an outflow side pressure, being adjustable such that said differential pressure limiting valve opens if a specifiable maximum pressure difference across the oil-mist separator is exceeded.

9. An apparatus according to claim 1, wherein the ventilation duct and the relief duct are designed as a common duct section over a part of their length.

10. An apparatus according to claim 1, wherein the oil-mist separator, the crankcase vacuum pressure regulating valve, the crankcase pressure limiting valve and at least partial sections of the ducts are comprised to form a single assembly-forming module that can be connected to the associated combustion engine either directly or via conduits.

11. An apparatus for ventilating a crankcase of a combustion engine, comprising:

a ventilation duct extending from the crankcase to an intake section of the combustion engine, at least one oil-mist separator positioned along a length of said ventilation duct, a crankcase vacuum pressure regulating valve positioned along said length of said ventilation duct and arranged to prevent a pressure in the crankcase from falling below a lower pressure limit value, a relief duct extending from the crankcase to the intake section of the combustion engine, a crankcase excess pressure limiting valve arranged along a length of said relief duct, and arranged to prevent an upper pressure limit value from being exceeded in the crankcase.

12. An apparatus according to claim 11, wherein a flowpath extending through said relief duct and excess pressure limiting valve includes at least one impingement surface for impingement by gasses flowing through said relief duct.

13. An apparatus according to claim 12, wherein said flowpath includes a sharp redirection of said flowpath near a location of said impingement surface.

14. An apparatus according to claim 11, wherein the crankcase excess pressure limiting valve is adjustable dependent on a difference between the crankcase pressure and a reference pressure.

15. An apparatus according to claim 11, wherein said crankcase excess pressure limiting valve is a diaphragm valve.

16. An apparatus according to claim 11, wherein an additional duct bypassing said oil-mist separator is provided, said bypass duct running from an inflow side to an outflow side of said oil-mist separator, with a separator differential pressure limiting valve being arranged along a length of said bypass duct and, depending on a difference between an inflow side pressure and an outflow side pressure, being adjustable such that said differential pressure limiting valve opens if a specifiable maximum pressure difference across said oil-mist separator is exceeded.

17. An apparatus according to claim 11, wherein said ventilation duct and said relief duct are designed as a common duct section over a part of their length.

18. An apparatus according to claim 11, wherein said oil-mist separator, said crankcase vacuum pressure regulating valve, said crankcase pressure limiting valve and at least partial sections of said ducts are comprised to form a single assembly-forming module that can be connected to the associated combustion engine either directly or via conduits.

* * * * *